US005140755A

United States Patent [19]

Simmons, Jr.

[11] Patent Number: 5,140,755

[45] Date of Patent: Aug. 25, 1992

[54] LAYOUT SQUARE

[76] Inventor: Rambert L. Simmons, Jr., 359 White Oak Rd., Fredericksburg, Va. 22405

[21] Appl. No.: 755,536

[22] Filed: Sep. 5, 1991

Related U.S. Application Data

[63] Continuation-in-part of Ser. No. 678,242, Apr. 1, 1991, abandoned.

[51] Int. Cl.[5] ..... B43L 7/00

[52] U.S. Cl. ..... 33/474; 33/476; 33/480

[58] Field of Search ..... 33/479, 480, 613, 476, 33/494, 562, 501

[56] References Cited

U.S. PATENT DOCUMENTS

| | | | |
|---|---|---|---|
| 686,240 | 11/1901 | Whitehill | 33/474 |
| 1,196,519 | 8/1916 | Caylor | 33/476 |
| 1,241,976 | 10/1917 | Hill | 33/476 |
| 1,665,400 | 4/1928 | Bittner | 33/501 |
| 3,169,320 | 2/1965 | Currie | 33/613 X |
| 3,834,033 | 5/1974 | Pinkard | 33/429 |
| 4,301,596 | 11/1981 | Sedlock | 33/494 |
| 4,499,666 | 2/1985 | Smith | 33/476 X |

*Primary Examiner*—Harry N. Haroian
*Attorney, Agent, or Firm*—Larson and Taylor

[57] ABSTRACT

An apparatus for laying out positions for the attachment of studs having a desired center to center spacing therebetween on a base plate includes a flat layout square which is precisely dimensioned for easily marking stud positions with a marker on the base plate. The layout square includes a short arm and a long arm extending perpendicularly from the short arm. In one embodiment, the short arm has a width which is equal to the actual thickness of the stud, and the long arm has a length from the intersection of the long arm which is equal to the stud spacing. This layout square also includes a dominant indicator adjacent a free end of the long arm which is spaced from the free end by an offset distance equal to one half of the width of the short arm. In one configuration, the indicator is an outside notch in the long arm and may also further include an inside notch in the long arm. In another configuration, the long arm includes regular measuring lines and the indicator is a dominating line which stands out from the regular measuring lines. It is preferred that the short arm also includes an overall length which is equal to the actual width of the stud. In another embodiment, the width of the short arm is one half of the thickness of the stud, and the long arm has an overall length equal to the stud spacing.

22 Claims, 3 Drawing Sheets

LAYOUT SQUARE

This is a continuation-in-part of application Ser. No. 678,242 filed Apr. 1, 1991, now abandoned.

FIELD OF THE INVENTION

The present invention relates generally to tools for laying out the positions of studs on a top plate, sole plate or the like, and more particularly to a layout square for quickly and easily laying out the positions of studs having a desired center to center spacing therebetween on such a plate.

BACKGROUND OF THE INVENTION

When buildings or the like are constructed using frame walls made out of lumber or other such framing elements, typically the frame walls include horizontal top and sole plates (hereinafter referred to as base plates) between which are provided vertical studs. It is usually necessary to precisely position the studs with a predetermined center to center spacing between the studs, including the studs attached to adjacent base plates of the wall. As the studs at the beginning and end of a base plate usually overlap with the adjacent base plate and are thus preferably attached to both, the measurement of the attachment positions of the various studs on the base plate requires some skill. In many cases, a single skilled carpenter is responsible for laying out all of the attachment positions of all of the studs on the various base plates, and other carpenters then simply follow the markings made by the skilled carpenter.

In order to make such measurements, the skilled carpenter makes use of a variety of tools. One such tool is a simple tape measure or folding rule. However, the use of such a tape measure or folding rule requires the skilled carpenter to compensate for the initial offset of the first stud on a base plate.

Also used for making such measurements is a rafter square. A rafter square is formed of two perpendicular arms. The long arm is typically 2" wide and has an outside edge length of 24" and an inside edge length of 22½". The shorter arm is typically 1½" wide and has an outside edge length of 16" and an inside edge length of 14". However, the use of this tool also requires the skilled carpenter to carefully measure each position.

Thus, it will be appreciated that a tool to quickly and easily measure the various stud positions on a base plate is needed in the art.

Tools of various designs and for various purposes have been disclosed in the prior art. For example, a floor square for use in marking a ledger notch in the end of a floor joist and for use in marking the intended position of a ledger on a girder is disclosed in U.S. Pat. No. 4,736,525 (Deason). The disclosed floor square has two arms perpendicular to one another. The short arm includes a notch in an outer edge thereof which is precisely dimensioned to match the size of the ledger notch to be cut from a floor joist. In addition, the length of the short arm from the inside edge of the long arm is also precisely configured so that the notch in the short arm is exactly located when the inside edge of the long arm is laid along the top of the floor joist.

Other tools of general interest and used for various purposes have been disclosed in the following U.S. Pat. Nos. 4,573,276 (Torczon) for a modified carpenter's square used for guiding tools; No. 2,756,505 (Zaleski) for a marking guide; No. 387,966 (Beckwith) for a combined gage and square; No. 2,654,153 (Oyler) for a device for estimating board feet in standing trees; and No. 4,654,978 (Wolford, Jr.) for a triangular marking guide for use with metal studs.

SUMMARY OF THE INVENTION

In accordance with the present invention, an apparatus for laying out positions for the attachment of studs having a desired center to center spacing therebetween on a base plate is provided. In a first embodiment, the apparatus includes a flat layout square integrally made in one-piece of a rigid and durable material and being precisely dimensioned for easily marking stud positions with a marker on the base plate. This layout square includes a short arm and a long arm extending perpendicularly from the short arm. The short arm has a width which is equal to the actual thickness of the stud, and the long arm has a length from the intersection with the short arm which is equal to the stud spacing. This layout square also includes a dominant indicator means adjacent a free end of the long arm which is spaced from the free end by an offset distance equal to one half of the width of the short arm. Thus, when the indicator means is placed at a beginning end of the base plate and subsequently when the free end of the long arm is placed at a previous mark on the base plate, with the long arm parallel to the stud in both instances, a mark for the proper position of a stud is simply made by drawing a marker along one of the edges of said short arm and on the surface of the base plate.

In a first preferred configuration, the indicator means includes an inside notch in the long arm extending from the free end along an inside edge of the long arm for the offset distance. In another preferred configuration, the indicator means further includes an outside notch in the long arm extending from the free end along an outside edge of the long arm for the offset distance.

In the preferred configuration of the present invention, the long arm includes regular measuring lines and indicia provided therealong. Then, the indicator means includes a dominating line which stands out from the regular measuring lines.

With any of these configurations, it is preferred that the short arm also includes an inside length which is equal to the actual width of the stud. In addition, it is preferred that the width of the short arm is 1½ inches, that the inside length of the long arm is 16 inches (for 16" stud spacing) or 24 inches (for 24" stud spacing), and that the width of the long arm is 1 inch.

In a second embodiment of the present invention, no dominant indicator means is used. Instead, the width of the short arm is equal to one-half of the actual thickness of the stud. The outer edge of the long arm then has an overall length from the intersection with the outer edge of the short arm to the free end thereof which is equal to the stud spacing. In use, when the free end of the long arm is placed at a beginning end of the base plate with the long arm parallel to the base plate, a mark for the proper position of a stud is simply made by drawing a marker along the inner edge of the short arm and on the surface of the base plate. Subsequently, when the free end of the long arm is placed at a previous mark on the base plate with the long arm parallel to the base plate, a mark for the proper position of a stud is simply made by drawing a marker along the outer edge of the short arm and on the surface of the base plate.

It is an advantage of the present invention that a convenient and easy to use tool is provided for laying out the positions markings of studs on a base plate.

It is also an advantage of the first embodiment of the present invention that both side positions of the stud can be quickly and easily marked to precisely locate the stud as belonging therebetween.

Other features and advantages of the present invention are stated in or apparent from detailed descriptions of presently preferred embodiments of the invention found hereinbelow.

DETAILED DESCRIPTION OF THE PREFERRED EMBODIMENTS

Figures 1, 2, 3:
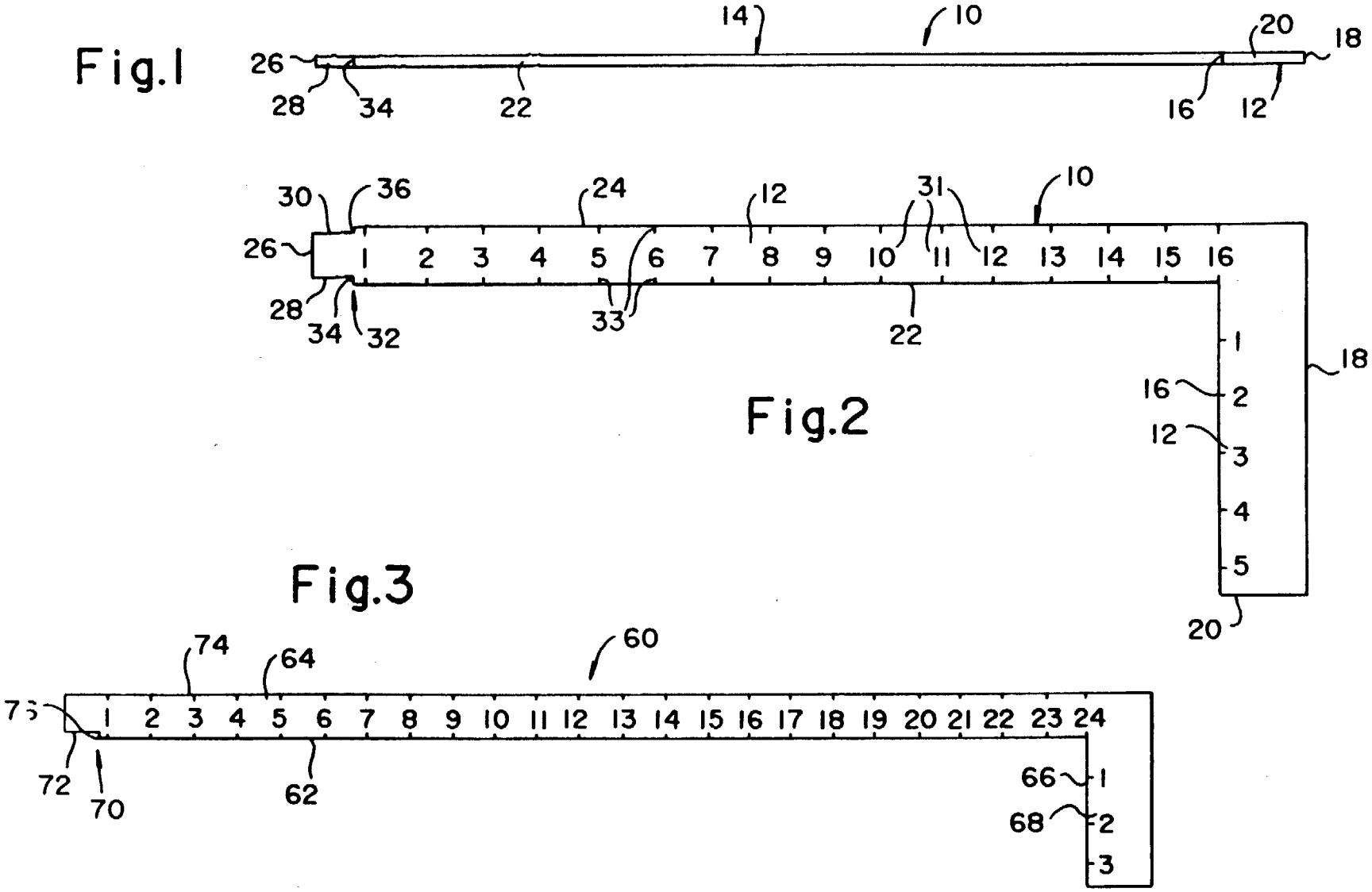
FIG. 1 is a front elevation view of a first embodiment of a layout square according to the present invention.
FIG. 2 is a top plan view of the layout square depicted in FIG. 1.
FIG. 3 is a top plan view of an alternative configuration of the first embodiment of a layout square according to the present invention.

With reference now to the drawings where like numerals represent like elements throughout the views, a layout square 10 according to a first configuration of a first embodiment of the present invention is depicted in FIGS. 1 and 2. It should be appreciated that layout square 10 is particularly designed to be used for laying out the positions for the attachment of studs having a desired center-to-center spacing therebetween on a top plate, sole plate or other such base plate or the like, as discussed subsequently in greater detail with respect to FIG. 5.

Layout square 10 is flat as shown and is conveniently integrally made in one piece out of a suitable rigid and durable material, typically a metal such as aluminum or steel. Layout square 10 includes a short arm 12 and a long arm 14 which lie in the same plane as shown in FIG. 1. Arms 12 and 14 extend perpendicular to one another and are generally rectangular in shape. Short arm 12 includes an inside edge 16, an outside edge 18 parallel to inside edge 16, and a free end 20 which extends perpendicular to edges 16 and 18. Long arm 14 similarly includes an inside edge 22, an outside edge 24 parallel to inside edge 22, and a free end 26 which extends perpendicular to edges 22 and 24. Provided adjacent free end 26 in long arm 14 is an inside notch 28 and an outside notch 30. Both notches 28 and 30 are rectangular cutouts of long arm 14 as shown.

Figure 4:
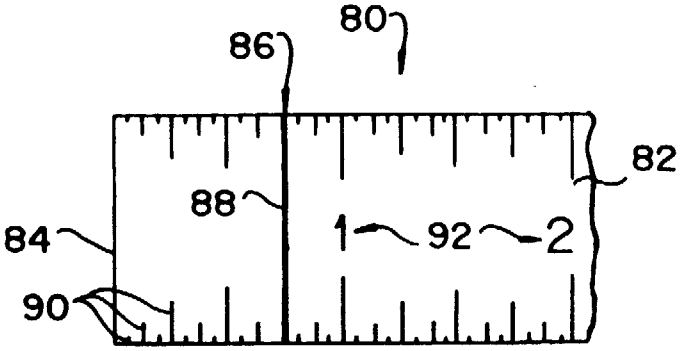
FIG. 4 is a top plan view of a portion of a long arm of another alternative configuration of the first embodiment of a layout square according to the present invention.

As desired, indicia 31 and corresponding lines 33 are provided along long arm 14 so that long arm 14 is generally usable for measurements. Suitably, lines 33 and indicia 31 mark off regular intervals, such as inches. Obviously, other lines and indicia could be provided to mark of intervals smaller than inches, and typically 1/16 inch intervals would be provided (such as shown in FIG. 4 for that configuration, but omitted here for clarity). Short arm 12 is also similarly provided with measuring indicia and lines as shown.

It should be appreciated that layout square 10 is precisely dimensioned, not merely because of its measuring lines which obviously must be precisely positioned to allow for accurate measurements to be made, but in the chosen dimensions for its key features. One such key feature is the precise length chosen for inside edge 22 (including that portion along notch 28) of long arm 14. This length is exactly a desired stud-to-stud centering dimension, in this configuration 16", from free end 26 to inside edge 16 of short arm 12. Another key feature is the width of short arm 12 from inside edge 16 to outside edge 18. This width dimension is chosen as the actual thickness dimension of the studs which are to be attached to the base plate, which in this preferred configuration is 1½" (the actual thickness of a nominal 2×4 or 2×6 commonly used in the U.S.).

A further key feature is the offset distance of a dominant indicator means 32 from free end 26. In this configuration of layout square 10, indicator means 32 is formed by an edge 34 of inside notch 28 and an edge 36 of outside notch 30. Edges 34 and 36 are both parallel to free end 26, and are located at a distance from free end 26 which is one half of the width of short arm 12. Thus, in this preferred configuration where the width of short arm 12 is 1½", the distance of edges 34 and 36 is one half of 1½" or ¾". It will therefore be appreciated that the distance from indicator means 32 (edges 34 and 36) to inside edge 16 of short arm 12 is the centering dimension less one half of the thickness of the stud, or in the preferred configuration 16" minus ¾" or 15¼". The length of edges 34 and 36 are not critical, but are chosen to be large enough so that edges 34 and 36 are easily identified or dominate the appearance of edges 22 and 24, but not so large that the portion of long arm 12 between notches 28 and 30 would be easily bent. A convenient length for edges 34 and 36 would thus be about ⅛", so that the width of long arm 14 between notches 28 and 30 would then be ¾". This dimension of edges 34 and 36 would seem to be a minimum in order to be easily seen, and thus using this minimum leaves long arm 14 therebetween with the maximum strength.

In this preferred embodiment, another key feature is the length of inside edge 16 of short arm 12. This dimension is chosen to match the actual width dimension of the studs to be attached to the base plate. In the depicted configuration, this length is 5½", and this corresponds to the actual width dimension of a nominal 2×6 commonly used in the U.S.

Still another dimension which is preferred for convenience, but which is not a key feature in the same sense as those discussed above, is the width of long arm 16. In this preferred embodiment, this dimension is selected to be 1". Such a dimension is sufficient to assure any required rigidity to long arm 16, and additionally such a dimension allows long arm 16 to be closely received in the loop normally provided on a carpenter's apron for receiving adjustable squares. Thus, layout square 10 is easily and conveniently carried in and removed from such a loop which will be usually available on each user having such an apron.

Figure 5:
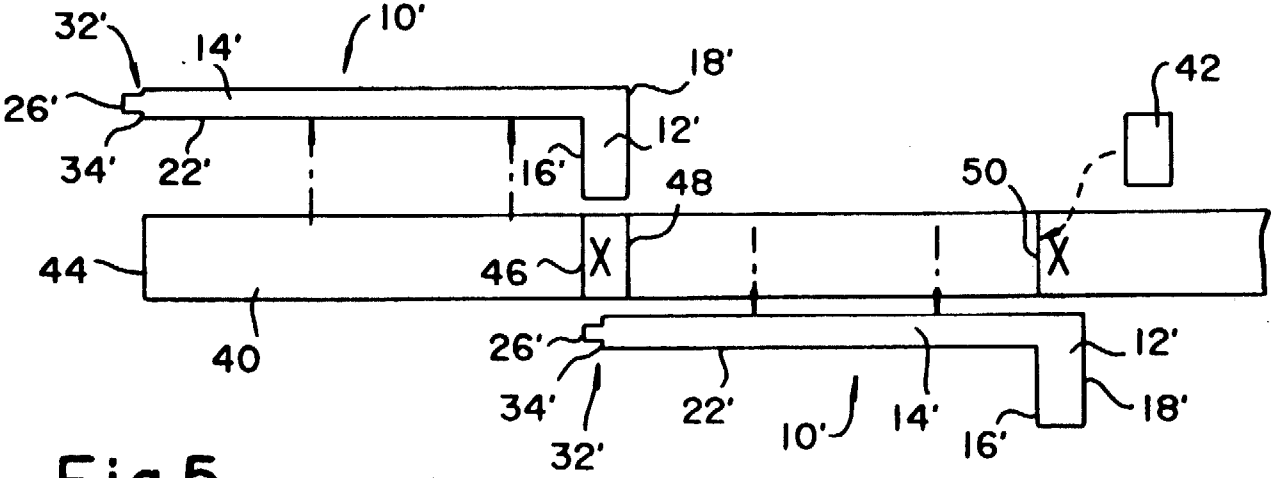
FIG. 5 is a schematic depiction of the use of a layout square with a stud according to the first embodiment of the present invention.

The use of a layout square 10', which is identical with layout square 10 except for the length of the inside edge which is 3½", is schematically depicted in FIG. 5. As layout square 10' is otherwise identical with layout square 10, the same identifying numerals will be used in describing layout square 10' as are used for layout square 10, but with the addition of a "'" after the numeral. In FIG. 5, it will be appreciated that a base plate 40 is depicted, which in this example is a nominal 2x4 whose actual dimensions as well appreciated by those of ordinary skill in the art is 1½" by 3½" (and having a standard length, typically of 8 feet). To this base plate 40, a plurality of studs, such as stud 42, are to be attached at predetermined positions. In this example, the predetermined spacing of the studs is 16", as is typically used and often required by various building codes.

While the desired spacing of each stud from another is 16 ", it will be appreciated that typically the first stud to be attached to base plate 40 must be located with the center thereof 16"]from an end 44 of base plate 40. However, what the experienced carpenter marks on base plate 40 is not the center of the stud—were the center position to be marked, this mark would then be covered or hidden from view when the stud is moved into position to be attached to base plate 40. Instead, the skilled carpenter makes a mark 46 which represents the (in this case) position of the left side of the stud—which thus will remain visible. Next to mark 46, the carpenter then makes an "X" or the like to show that the body of the stud goes over this area while the chosen side is placed in alignment with mark 46 which thus remains visible during placement and attachment.

In order to easily make mark 46 with layout square 10' according to the present invention in the proper location, inside edge 22' of long arm 14' is laid along or on top of base plate 40 and positioned therealong until indicator means 32' and in particular edge 34' aligns with end 44 of base plate 40. It will be appreciated that for clarity, layout square 10' has been depicted twice, each time to one side of base plate 40 with an arrow used to show where layout square 10' would be placed on base plate 40. With long arm 14' parallel with base plate 40, inside edge 15' of short arm 12' is then precisely located 15¼ from end 44 of base plate 40 at the position where mark 46 is to be made.

It is thus a simple procedure to align indicator means 32' (and in particular edge 34')with end 44 of base plate 40 and to then draw mark 46 with a pencil or the like at the precisely desired location. Further, if desired, a mark 48 can also be made at the same time along outside edge 18' of short arm 12' so that the location of the stud is understood to be between marks 46 and 48. The use of mark 48 is conveniently made in place of the "X", more quickly, simply, and to serve as a check on the exact positioning of the stud. However, the "X" can also be used as normally done without use of mark 48 if desired, or an "X" can be subsequently placed between marks 46 and 48 to reinforce the positioning information of marks 46 and 48.

With mark 46 precisely located, the remainder of marks 50 (only one is shown) to be provided on base plate 40 are located at 16" intervals from mark 46. In order to provide these marks, free end 26' of long arm 12' is simply placed at mark 46 (the previous left side mark). Then, with long arm 12' parallel to base plate 40, the proper position of the next mark 50 is where inside edge 16' of short arm 12' is located. Thus, mark 50 is simply made once free end 26' is properly located. Thereafter, the remaining marks 50 are similarly made by simply aligning free end 26' with the previous (left side) mark 50 to provide 16" spacings for the remainder of the studs to be attached to base plate 40. As with mark 46, a complementary mark using outside edge 18' can also be made at the same time that mark 50 is made, as desired.

Obviously, this simple and easy procedure is then repeated for the corresponding base plate (on the other end of the studs), and for other pairs of base plates as required. Where non-centered studs are required to be located on the base plate, the locations of such studs are done in the usual manner, with the layout square being used for all 16" marks. In addition, by use of indicia 31 and lines 33, it is also possible to use the layout square for marking these non-standard positions.

Depicted in FIG. 3 is an alternative configuration of a layout square 60 according to the present invention. Layout square 60 is basically similar to layout square 10 described above, but layout square 60 is designed to precisely locate position markings for 2×4s on 24" centers. Thus, layout square 60 has an inside edge 62 of long arm 64 which is 24" long and an inside edge 66 of short arm 68 which is 3½" long. In this configuration, layout square 60 also includes an indicator means 70 formed by a single notch 72 provided along inside edge 62 of long arm 64. Notch 72 is conveniently cut somewhat deeper into inside edge 62 so that edge 76 is more easily located and dominates inside edge 62 adjacent end 44 of base plate 40. However, the precise location of indicator means 70 is still the same as in layout square 10 discussed above, as are the remainder of the key features not specifically discussed.

In use, layout square 60 is used in the same basic manner as layout square 10' discussed above, but obviously for 24' stud spacings.

Depicted in FIG. 4 is an exemplary portion of still another alternative configuration of a layout square 80. The depicted portion is the end of a long arm 82 adjacent a free end 84. In this configuration, long arm 82 includes an indicator means 86 which is a dominating line 88. Dominating line 88 has an appearance which stands out dramatically over the appearance of usual measuring lines 90 and the associated indicia 92. Thus, it will be appreciated that long arm 82 is marked off by measuring lines 90 into 1/16th inch increments in a manner typical to rulers and the like. However, at the ¾" position which is the desired offset distance as discussed above, dominating line 88 stands out over all of measuring lines 90 so that dominating line 88 is easy to locate and position at end 44 of base plate 40.

The remainder of layout square 80 is configured in the same manner as layout squares 10, 10' or 60, or as otherwise desired consistent with the present invention. In use, it will be appreciated that layout square 80 is used in the same manner as layout squares 10, 10' or 60 discussed above.

Figure 6:
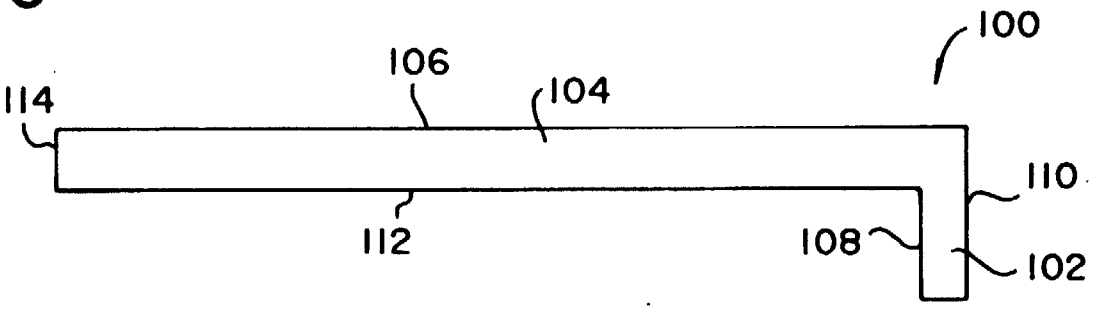
FIG. 6 is a top plan view of a second embodiment of a layout square according to the present invention.
Figure 7:
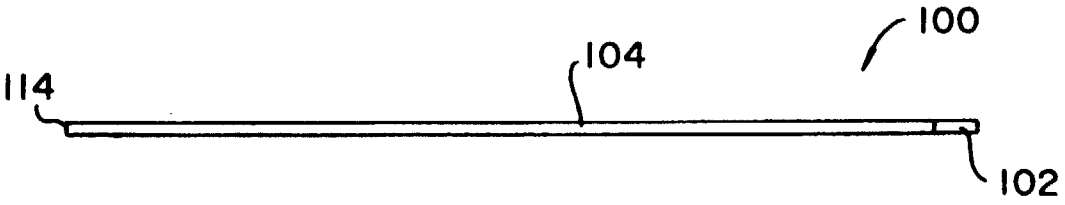
FIG. 7 is a front elevation view of the layout square depicted in FIG. 6.

Depicted in FIGS. 6 and 7 is a second embodiment of a layout square 100 according to the present invention. Layout square 100 is basically similar to layout square 10 described above, and thus includes a short arm 102 and a long arm 104. However, layout square 100 is used in a slightly different manner than layout square 10, and thus is sized with some different critical dimensions.

In particular, outside edge 106 of long arm 104 is exactly equal to the stud spacing length (16" in the depicted configuration and hence similar to that of layout square 10). In addition, the width of short arm 102, that is the distance between inside edge 108 and outside edge 110, is exactly equal to one-half of the width of the stud (¾" in the depicted configuration). It will thus be appreciated that the critical distance of inside edge 112 of long arm 104 is thus the stud spacing distance minus one-half of the stud width.

Other dimensions of layout square 100 are then similar to layout squares 10, 60, and 80 discussed above. For example, the length of short arm 102 from inside edge, 112 of long arm 104 is preferably equal to the stud width. In addition, the width of long arm 104 is preferably 1" to fit conveniently in the usual loops provided on carpenter's aprons.

In use, layout square 100 is used to lay out the same series of lines as the other layout squares discussed above. However, layout square is used somewhat differently and is considered somewhat simpler to use. In use for the first mark, free end 114 of long arm 104 is simply placed in alignment with end 44 of base plate 40. As the first mark is desired at a distance of only 15¼" (for 16" stud spacings with 1½" thick studs), it will be appreciated that inside edge 108 is thus at this critical location and a mark is easily made by drawing a marker along inside edge 108 and on the surface of base plate 40.

Thereafter, as each subsequent mark is desired to be 16" from the previous mark, free end 114 is then simply aligned with the previous mark so that outside edge 110 of short arm 102 is then spaced exactly 16" from the previous mark. A subsequent mark is then easily made by drawing a marker along outside edge 110 and on the surface of base plate 40.

Although layout squares 10, 10', 60, 80 and 100 have been described as being used for studs having an actual thickness of 1½", it will be appreciated that this is simply the standard used in the U.S. Where other standard thicknesses are used or subsequently adopted, suitable changes would obviously be made as well appreciated by those of ordinary skill in the art. Similarly, while the use of the present invention has been described for 16" or 24" stud spacings, where other standard spacings are used or desired, the layout square of the present invention would again obviously be changed to suit those circumstances. In addition, other dominant indicator means would also be possible for the first embodiment.

Thus, while the present invention has been described with respect to exemplary embodiments thereof, it will be understood by those of ordinary skill in the art that variations and modifications can be effected within the scope and spirit of the invention.

I claim:

1. An apparatus for laying out positions for the attachment of studs having a desired center to center spacing therebetween on a base plate comprising:

a flat layout square made of a rigid and durable material and being precisely dimensioned for easily marking stud positions with a marker on the base plate, said layout square including a short arm and a long arm longer than said short arm and extending perpendicularly from said short arm whereby said arms have respective inner edges and outer edges parallel to one another and terminating at free ends thereof perpendicular to said respective edges, wherein said short arm has a width from said inner edge to said outer edge thereof which is equal to the actual thickness of the stud and wherein said inner edge of said long arm has a length from the intersection with said inner edge of said short arm to said free end thereof which is equal to the stud spacing, and a dominant indicator means adjacent the free end of said long arm which is spaced from said free end of said long arm by an offset distance equal to one half of the width of said short arm, said indicator means including a notch in said long arm extending from said free end of said long arm along one of said side edges of said long arm for the offset distance;

such that when said indicator means is placed at a beginning end of the base plate and subsequently when said free end of said long arm is placed at a previous mark on the base plate with said long arm parallel to the base plate, a mark for the proper position of a stud is simply made by drawing a marker along one of said edges of said short arm and on the surface of the base plate.

2. An apparatus for laying out positions as claimed in Claim 1 wherein said indicator means includes an inside notch in said long arm extending from said free end of said long arm along said inside edge of said long arm for the offset distance.

3. An apparatus for laying out positions as claimed in Claim 2 wherein said indicator means further includes an outside notch in said long arm extending from said free end of said long arm along said outside edge of said long arm for the offset distance.

4. An apparatus for laying out positions as claimed in Claim 1 wherein said long arm includes regular measuring lines and indicia provided therealong, and wherein said indicator means includes a dominating line which stands out from the regular measuring lines.

5. An apparatus for laying out positions as claimed in Claim 1 wherein said inside edge of said short arm also has an overall length which is equal to the actual width of the base plate.

6. An apparatus for laying out positions as claimed in Claim 1 wherein the width of said short arm from said inside edge to said outside edge thereof is 1½inches.

7. An apparatus for laying out positions as claimed in Claim 6 wherein the length of said inner edge of said long arm is 16 inches.

8. An apparatus for laying out positions as claimed in Claim 6 wherein the length of said inner edge of said long arm is 24 inches.

9. An apparatus for laying out positions as claimed in Claim 6 wherein the width of said long arm from said inside edge to said outside edge thereof is 1 inch.

10. An apparatus for laying out positions for the attachment of 1½ inch thick studs having a desired center to center spacing therebetween of 16 inches on a base plate comprising:

a flat layout square made of a rigid and durable material and being precisely dimensioned for easily marking stud positions with a marker on the base plate, said layout square including a short arm which is generally rectangularly shaped and having a width of 1½ inches, a long arm which is generally rectangularly shaped and which extends perpendicularly from said short arm whereby said arms have respective inner edges and outer edges parallel to one another and terminating at free ends thereof, said inner edge of said long arm having a length from the intersection of said inner edge of said short arm which is 16 inches, and respective outside and inside notches provided in respective said outside and inside edges of said long arm adjacent said free end thereof, said notches extending from said free end of said long arm by an offset distance equal to one half of the width of said short arm;

such that when said notches are placed at a beginning end of the base plate and with said long arm parallel to the base plate and subsequently when said free end of said long arm is placed at a previous mark on the base plate with said long arm parallel to the base plate, a mark for the proper position of a stud is simply made by drawing a marker along one of said edges of said short arm and on the surface of the base plate.

11. An apparatus for laying out positions as claimed in Claim 10 wherein said inner edge of said short arm has a length which is equal to the actual width of the base plate.

12. An apparatus for laying out positions as claimed in Claim 11 wherein the width of said long arm from said inner edge to said outer edge thereof is 1 inch.

13. An apparatus for laying out positions for the attachment of studs having a desired center to center spacing therebetween on a base plate comprising:

a layout square which is integrally made in one piece of a rigid and durable material, and which is precisely dimensioned for easily marking stud positions with a marker on the base plate, said layout square including a short arm and a long arm longer than said short arm and extending perpendicularly from said short arm, said arms lying in the same plane and having respective inner edges and outer edges parallel to one another and terminating at free ends thereof perpendicular to said respective edges, wherein said short arm has a width from said inner edge to said outer edge thereof which is equal to the actual thickness of the stud and wherein said inner edge of said long arm has a length from the intersection with said inner edge of said short arm to said free end thereof which is equal to the stud spacing, and a dominant indicator means adjacent the free end of said long arm which is spaced from said free end of said long arm by an offset distance equal to one half of the width of said short arm;

such that when said indicator means is placed at a beginning end of the base plate and subsequently when said free end of said long arm is placed at a previous mark on the base plate with said long arm parallel to the base plate, a mark for the proper position of a stud is simply made by drawing a marker along one of said edges of said short arm and on the surface of the base plate.

14. An apparatus for laying out positions as claimed in Claim 13 wherein said long arm includes regular measuring lines and indicia provided therealong, and wherein said indicator means includes a dominating line which stands out from the regular measuring lines.

15. An apparatus for laying out positions as claimed in Claim 13 wherein said inside edge of said short arm also has an overall length which is equal to the actual width of the base plate.

16. An apparatus for laying out positions for the attachment of studs having a desired center to center spacing therebetween on a base plate comprising:

a layout square which is integrally made in one piece of a rigid and durable material, and which is precisely dimensioned for easily marking stud positions with a marker on the base plate, said layout square including a short arm and a long arm longer than said short arm and extending perpendicularly from said short arm, said arms lying in the same plane and having respective inner edges and outer edges parallel to one another and terminating at free ends thereof perpendicular to said respective edges, wherein said short arm has a width from said inner edge to said outer edge thereof which is equal to one-half of the actual thickness of the stud and wherein said outer edge of said long arm has an overall length from the intersection with said outer edge of said short arm to said free end thereof which is equal to the stud spacing;

such that when said free end of said long arm is placed at a beginning end of the base plate with said long arm parallel to the base plate, a mark for the proper position of a stud is simply made by drawing a marker along said inner edge of said short arm and on the surface of the base plate, and subsequently when said free end of said long arm is placed at a previous mark on the base plate with said long arm parallel to the base plate, a mark for the proper position of a stud is simply made by drawing a marker along said outer edge of said short arm and on the surface of the base plate.

17. An apparatus for laying out positions as claimed in Claim 16 wherein said long arm includes regular measuring lines and indicia provided therealong.

18. An apparatus for laying out positions as claimed in Claim 16 wherein said inside edge of said short arm also has an overall length which is equal to the actual width of the base plate.

19. An apparatus for laying out positions as claimed in Claim 16 wherein the width of said short arm from said inside edge to said outside edge thereof is $\frac{3}{4}$ inches.

20. An apparatus for laying out positions as claimed in Claim 19 wherein the length of said outer edge of said long arm is 16 inches.

21. An apparatus for laying out positions as claimed in Claim 19 wherein the length of said outer edge of said long arm is 24 inches.

22. An apparatus for laying out positions as claimed in Claim 16 wherein the width of said long arm from said inside edge to said outside edge thereof is 1 inch.

* * * * *